US006139017A

United States Patent [19]

Kawamura

[11] Patent Number: 6,139,017

[45] **Date of Patent: *Oct. 31, 2000**

[54] PREMIUM-DISPENSING GAME

[75] Inventor: Yasunori Kawamura, Sagamihara, Japan

[73] Assignee: Sammy Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/195,576

[22] Filed: Nov. 10, 1998

[51] Int. Cl.[7] ..... A63F 9/00

[52] U.S. Cl. ..... 273/445; 273/138.1; 273/138.2; 463/16

[58] Field of Search ..... 273/138.1, 138.2, 273/139, 440, 445, 446, 454, 459, 460; 463/16, 25; 221/82, 90, 92, 119, 199, 312 R

[56] References Cited

U.S. PATENT DOCUMENTS

| | | | |
|---|---|---|---|
| 2,044,320 | 6/1936 | Norris | 221/82 X |
| 4,869,500 | 9/1989 | Williams | 463/25 X |
| 5,344,199 | 9/1994 | Carstens et al. | 273/138.1 |
| 5,529,206 | 6/1996 | Kumagai | 221/90 X |
| 5,584,763 | 12/1996 | Kelly et al. | 463/16 |

*Primary Examiner*—Raleigh W. Chiu
*Attorney, Agent, or Firm*—Laff, Whitesel & Saret, Ltd.

[57] ABSTRACT

A self-contained game is provided wherein a player attempts to win one of a plurality of premiums displayed within the game. The game includes a premium-display space surrounded by a first plurality and second plurality of indicators. The indicators may be incandescent lamps. A controller is provided which is configured to sequentially distinguish and extinguish individual indicators comprising said first and second pluralities in a manner to give the appearance of a single indication traveling amongst said first and second plurality of indicators. A player may arrest the apparent motion of said traveling indication by actuating an interface device in an attempt to stop the indication at a selected position corresponding to one of the indicators comprising the second plurality of indicators. The controller is configured to determine which indicator was last distinguished at the time the interface was actuated, and whether the last distinguished indicator is a member of the second plurality. The controller is further configured to make a decision whether a premium is to be dispensed based on the determination that said last distinguished indicator is a member of the second plurality of indicators. A plurality of premium supports are positioned within the premium display space and are configured to releasably support premiums within the display space. Each of the supports is associated with a respective one of the second plurality of indicators so that upon the controller making a decision that a premium is to be dispensed, the controller acts to cause the premium support associated with the last distinguished indicator to release a premium.

9 Claims, 10 Drawing Sheets

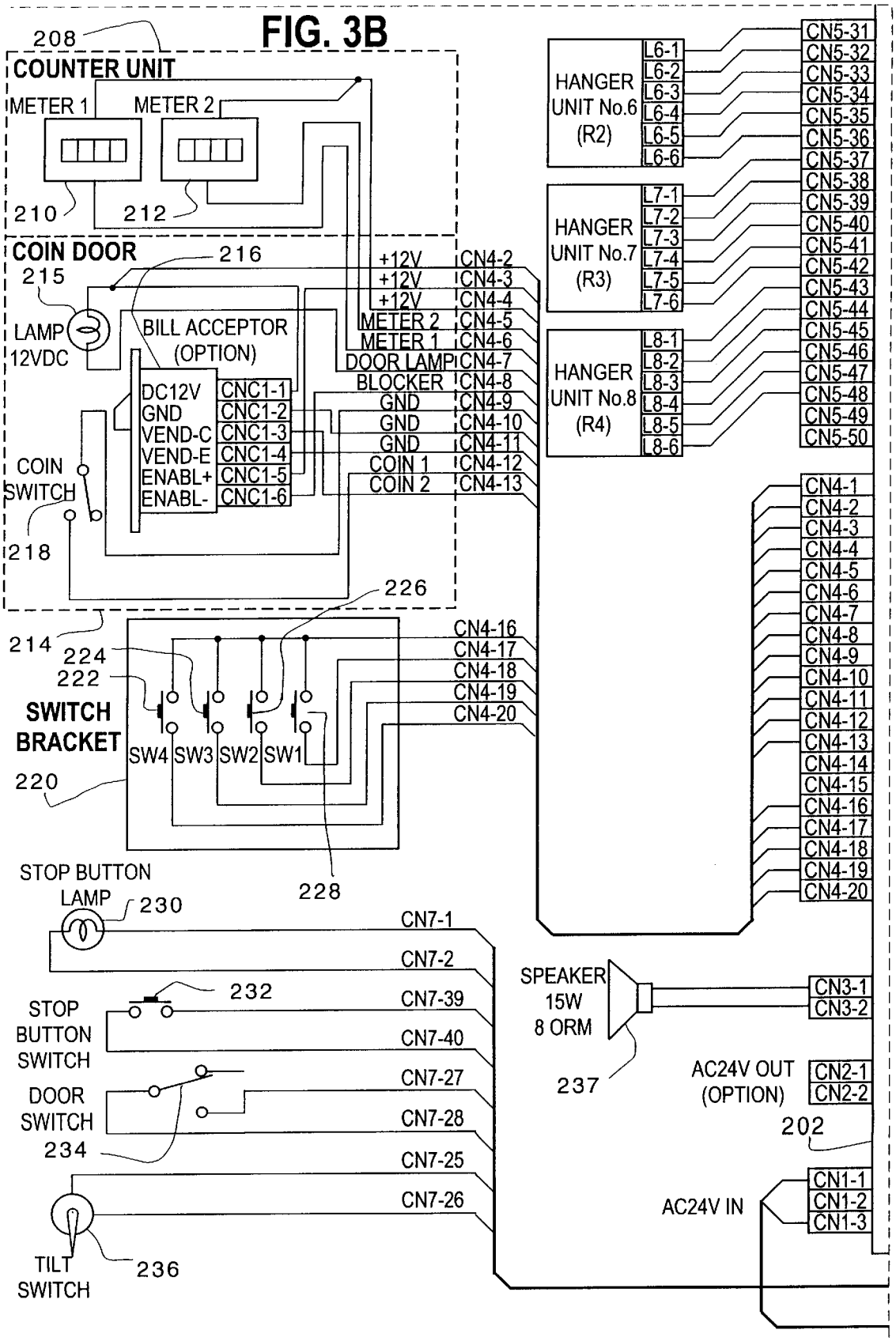
FIG. 3B
208
COUNTER UNIT
METER 1
METER 2
210
212
COIN DOOR
215
216
LAMP
12VDC
BILL ACCEPTOR
(OPTION)
DC12V
GND
VEND-C
VEND-E
ENABL+
ENABL-
CNC1-1
CNC1-2
CNC1-3
CNC1-4
CNC1-5
CNC1-6
COIN
SWITCH
218
+12V
+12V
+12V
METER 2
METER 1
DOOR LAMP
BLOCKER
GND
GND
GND
COIN 1
COIN 2
CN4-2
CN4-3
CN4-4
CN4-5
CN4-6
CN4-7
CN4-8
CN4-9
CN4-10
CN4-11
CN4-12
CN4-13
HANGER UNIT No.6 (R2)
L6-1
L6-2
L6-3
L6-4
L6-5
L6-6
HANGER UNIT No.7 (R3)
L7-1
L7-2
L7-3
L7-4
L7-5
L7-6
HANGER UNIT No.8 (R4)
L8-1
L8-2
L8-3
L8-4
L8-5
L8-6
CN5-31
CN5-32
CN5-33
CN5-34
CN5-35
CN5-36
CN5-37
CN5-38
CN5-39
CN5-40
CN5-41
CN5-42
CN5-43
CN5-44
CN5-45
CN5-46
CN5-47
CN5-48
CN5-49
CN5-50
CN4-1
CN4-2
CN4-3
CN4-4
CN4-5
CN4-6
CN4-7
CN4-8
CN4-9
CN4-10
CN4-11
CN4-12
CN4-13
CN4-14
CN4-15
CN4-16
CN4-17
CN4-18
CN4-19
CN4-20
214
224
222
226
SWITCH BRACKET
220
SW4
SW3
SW2
SW1
CN4-16
CN4-17
CN4-18
CN4-19
CN4-20
228
STOP BUTTON LAMP
230
CN7-1
CN7-2
STOP BUTTON SWITCH
232
CN7-39
CN7-40
DOOR SWITCH
234
CN7-27
CN7-28
CN7-25
CN7-26
TILT SWITCH
236
SPEAKER
15W
8 ORM
237
CN3-1
CN3-2
AC24V OUT
(OPTION)
CN2-1
CN2-2
202
AC24V IN
CN1-1
CN1-2
CN1-3

CN6-1
CN6-2
CN6-3
CN6-4
CN6-1
CN6-2
CN6-3
CN6-4
202
204
244
CN5-1
CN5-2
CN5-3
CN5-4
CN5-5
CN5-6
CN5-7
CN5-8
CN5-9
CN5-10
CN5-11
CN5-12
CN5-13
CN5-14
CN5-15
CN5-16
CN5-17
CN5-18
CN5-19
CN5-20
CN5-21
CN5-22
L45
L64
LEFT
LAMP
BRACKET
CN7-1
CN7-2
CN7-3
CN7-4
CN7-5
CN7-6
CN7-7
CN7-8
CN7-9
CN7-10
CN7-11
CN7-12
CN7-13
CN7-14
CN7-15
CN7-16
CN7-17
CN7-18
CN7-19
CN7-20
CN7-21
CN7-22
CN7-23
CN7-24
CN7-25
CN7-26
CN7-27
CN7-28
CN7-29
CN7-30
CN7-31
CN7-32
CN7-33
CN7-34
CN7-35
CN7-36
CN7-37
CN7-38
CN7-39
CN7-40
CN1-1
CN1-2
FLUORESCENT LIGHT
FL-20W (TOP MARQUEE)
246
FLUORESCENT LIGHT
FL-20W (UPPER PLAY-FIELD)
248
252
FUSE 5A
SLOW-BLOW
MAIN
SWITCH
LINE IN
120VAC
251
250
24VAC OUT
(10A)
254
256
120VAC IN
FUSE 8A
SLOW-BLOW
TRANSFORMER

PREMIUM-DISPENSING GAME

BACKGROUND OF THE INVENTION

The present invention relates to a premium-dispensing game wherein, for a fee or otherwise, a player may attempt to win a premium or prize. More particularly, the present invention relates to a self-contained premium-dispensing game which may be operated unattended, and which will assure the operator an approximated return based on the skill of those playing the game and various other parameters which may be adjusted by the operator of the game.

Premium-dispensing games are known in the art. For example, U.S. Pat. No. 5,529,206 to Kumagai discloses a game machine that automatically ejects gifts by means of a selection device comprising various cyclically lighting lamps located near each gift display. A particular gift is selected by pressing a selection button which first stops the cyclical lighting on a particular prize display tier, then stops the cyclical lighting at a particular prize position located along the selected prize display tier. The prize adjacent the position selected is then ejected by the game machine. In short, the game machine of Kumagai operates merely as a prize vending machine, and there is no level of skill or chance involved in winning a prize.

U.S. Pat. No. 4,976,440 to Williams discloses a self-contained prize-dispensing game machine that also dispenses a prize each time the machine is activated. However, due to the nature of the operation of the machine, it appears that a player is winning a prize by chance. Again, this game actually vends prizes with no skill or luck involved in the determination of whether a prize will be dispensed.

Another game disclosed in U.S. Pat. No. 4,976,440 requires a player to actuate a mechanism which strikes or grabs at a prize as it falls through the machine. A toy which is successfully grabbed is dispensed by the machine. This game requires a level of skill to retrieve a prize; however, apart from the level of difficulty in grabbing a prize, it does not introduce an element of chance which will insure a certain financial return to the operator of the machine.

Other game machines are known which will dispense tickets based on a player's performance. In such games, performance may be dictated by a player's skill, chance, or a combination thereof. Often such games are operated in arcade settings wherein a player may accumulate a number of tickets which may redeemed for prizes. Such games, require an attendant to redeem the tickets and dispense prizes, thereby increasing the cost of operating the games.

What is desired is a self-contained premium-dispensing game which will provide a random financial return for the operator above an adjustably set minimum, wherein the level of skill of individual players determines the actual return. By including an element of skill to determine the actual premium pay-out rate, the game will entice more players to try their hand. It is further desired that such a game be operable without an attendant so that the game may continuously dispense premiums over an extended period without requiring servicing. Another desirable feature of such a self-contained, self-operating game is to allow a player to choose a particular premium which he will attempt to win from among a plurality of different premiums. It is further desirable to adjustably control the chances of winning the various premiums based on the value of premiums and the financial return desired from operating the game. A final desirable feature for such a self-contained premium-dispensing game is to include a mechanism for preventing vandals from shaking premiums loose from their displays and stealing the premiums without playing the game.

SUMMARY OF THE INVENTION

In light of the background given above, a primary object of the present invention is to provide a self-contained premium-dispensing game which may be operated unattended.

Another object of the invention is to provide a self-contained premium-dispensing game which combines a player's skill with an element of chance to determine when a premium is to be dispensed.

Yet another object of the invention is to provide a premium-dispensing game wherein the operator of the game may select a predefined desired minimal financial return from operating the game and wherein the actual financial return will exceed said desired minimum depending on the skill of those playing the game. Based on the value of the premiums and the price charged for playing the game, the game will determine the number of premiums to be dispensed in order to meet the desired minimum financial return.

Still another object of the invention is to provide a premium-dispensing game which provides a plurality of different premiums which may be of different values, and wherein a player may choose which premium he will attempt to win.

An additional object of the invention is to provide a premium-dispensing game wherein the chances of winning higher-valued premiums are lower than the chances of winning a lower-valued premium.

A further object of the invention is to provide a premium-dispensing game which includes provisions to prevent premiums from being inadvertently dispensed due to improper handling of the game mechanism.

All of these objects, as well as others which will become apparent upon reading the detailed description of the preferred embodiment, are met by the Premium-Dispensing Game as herein disclosed.

In the preferred embodiment, a self-contained premium-dispensing game is provided wherein a player attempts to win one of several different premiums visibly displayed within the game. Physically the game comprises a base with an upper casing thereon. An illuminated marquee may be included above the casing. The upper casing defines a premium-display space surrounded by a plurality of lamps including a number of noticeably distinct "win position" lamps. A plurality of premium display supports or carousels are mounted within the display space, and a plurality of different premiums are hung therefrom. The base includes slots for receiving coins or bills in order to initiate a play through which a player attempts to win one of the premiums displayed within the premium-display space. Further, a stop button is located on a small ledge on top of the base in front of the display space.

A controller mounted within the game is configured to selectively illuminate and extinguish individual lamps surrounding the display space. In the preferred embodiment the lamps are illuminated and extinguished sequentially such that it appears that a single light is racing around the perimeter of the display space. A player attempts to win a premium by pressing the stop button while the traveling light is illuminating one of the lamps corresponding to one of the win positions. If successful, the player wins the premium suspended from the premium support adjacent the illuminated win position lamp, and the display carousel responds to commands from the controller to eject one of the premiums. Otherwise, the carousels include a spring-biased locking lever which acts to retain the premiums on the carousels in order to prevent inadvertently dispensing prizes.

It should be further noted that the controller is configured so that a player may not win a premium every play in which the stop button is pressed at the proper instant Rather a win will be allowed in accordance with a predefined Win Expectation Value which is calculated to define a minimum financial return from operating the game, and wherein the actual return is determined by the skill level of those playing the game in combination with the calculated Win Expectation Value. Different Win Expectation Values may be provided for each display carousel, so that some premiums (those of higher value) will be harder to win than others.

DETAILED DESCRIPTION OF THE PREFERRED EMBODIMENT

Figure 1:
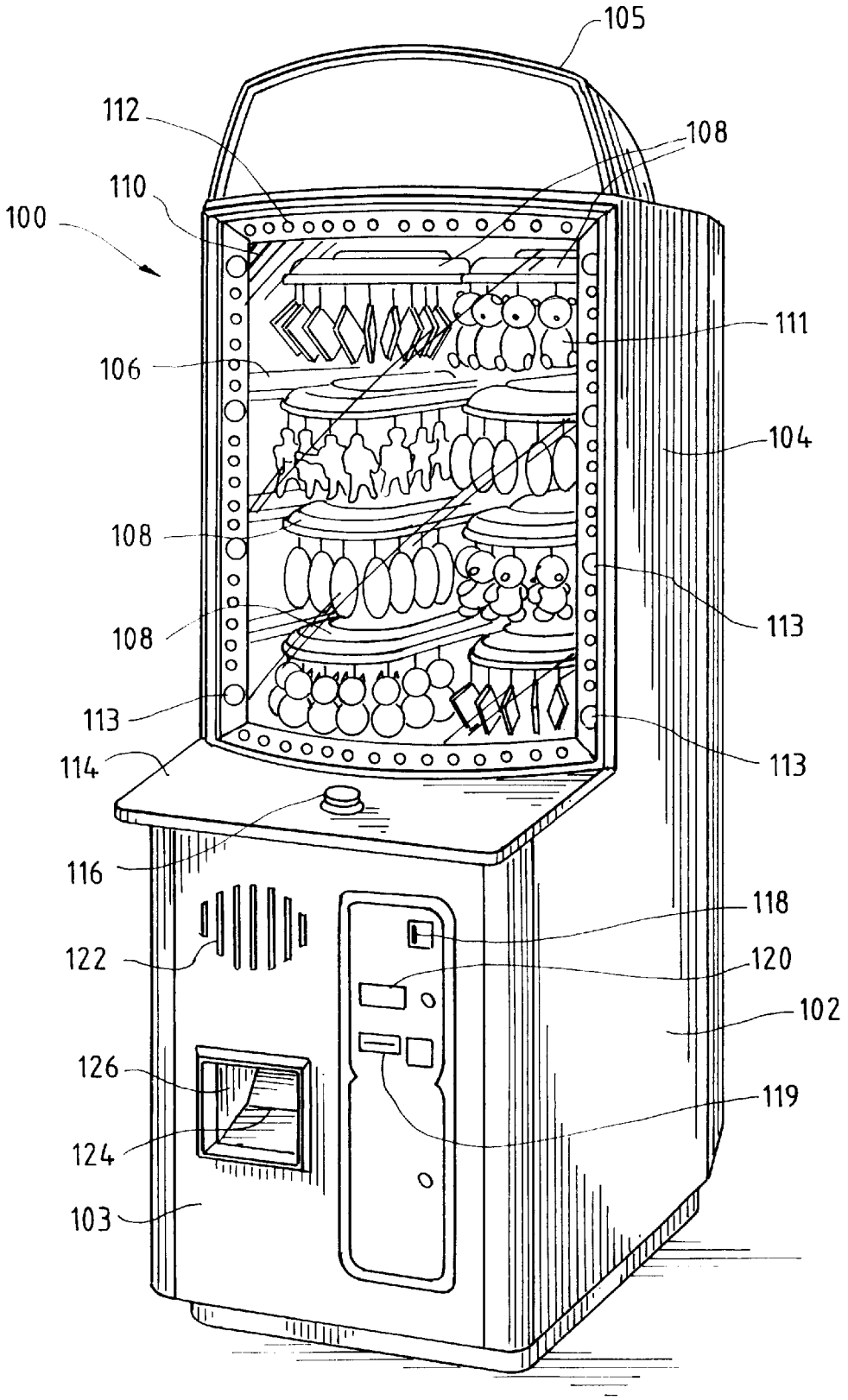
FIG. 1 shows a perspective view of the Premium-Dispensing Game according to the preferred embodiment of the invention.

Referring to FIG. 1 a self-contained premium-dispensing game according to the present invention is shown at 100. The premium-dispensing game 100 comprises, a base 102 and an upper casing 104. An illuminated marquee 105 sits atop casing 104. Casing 104 encloses a premium-display space 106 which includes a plurality of premium display carousels 108. The carousels 108 support premiums, or prizes, 111 which are to be dispensed when a player wins the game. Carousels 108 not only support the premiums, but also act to dispense the appropriate premium 111 when a player wins. A transparent barrier 110 formed of polycarbonate or glass or some other clear material encloses the premium-display space 106. A locking hinged door (not shown) is provided so that the display carousels may be replenished through the front of the machine after a significant number of premiums have been dispensed.

A plurality of lamps 112 frame the premium-display space 106. Included among lamps 112 are a plurality of "WIN" lamps 113. The number of win lamps corresponds to the number of display carousels 108. The "WIN" lamps 113 may be a different color or shine brighter than the remainder of lamps 112.

A shallow ledge 114 is formed above base 102 and below and in front of casing 104. A depressable "STOP" button 116 is provided approximately in the center of ledge 114. Base 102 further includes a speaker aperture 122, a coin slot 118, and optionally a bill slot 119 and ticket dispenser 120. A premium-dispensing chute 124 extends through base 102 between premium-display space 106 and a dispensing aperture 126 formed in a front surface 103 of base 102. A prize guard (not shown) may be included to prevent vandals from reaching up into the machine and stealing premiums.

Figure 2:
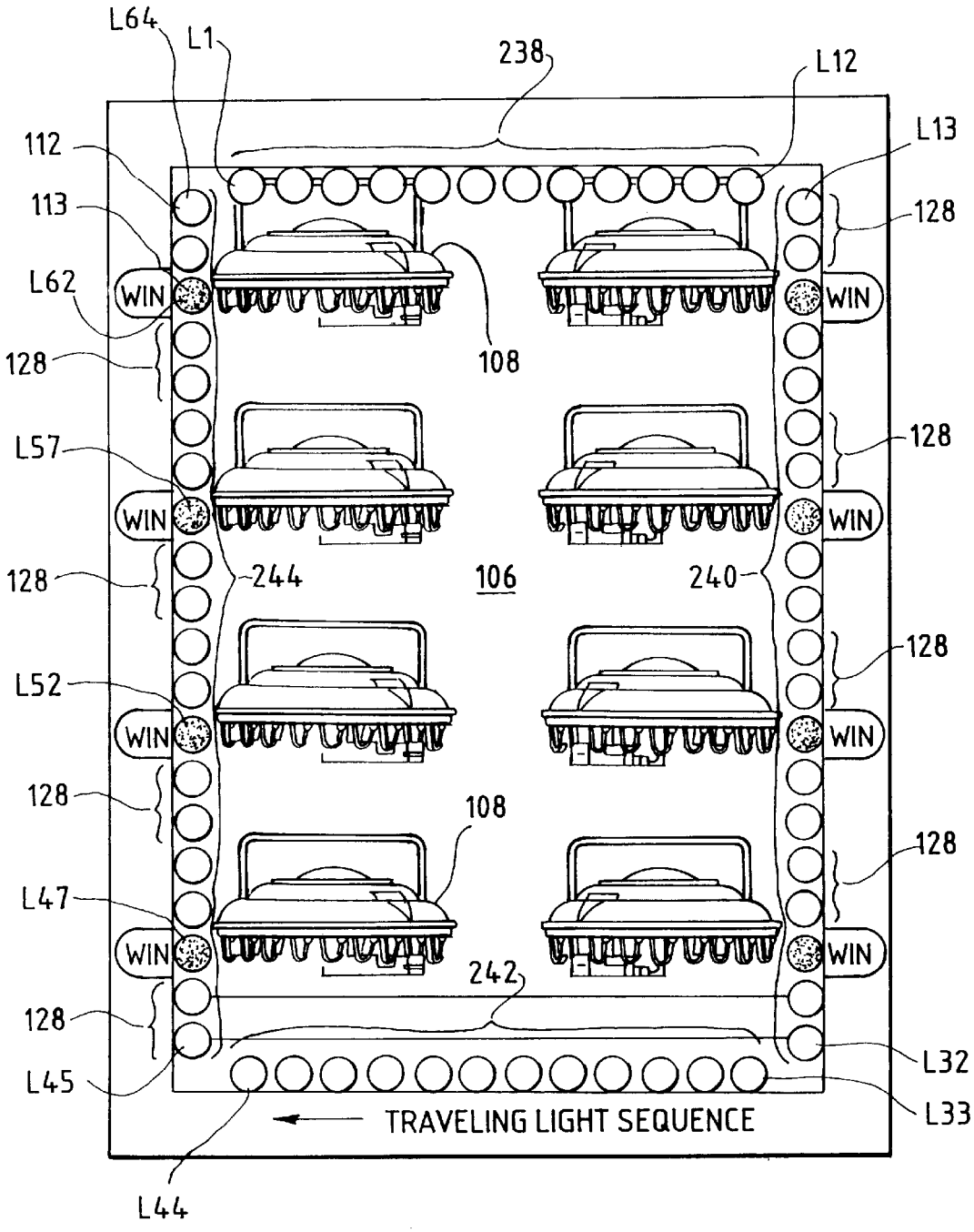
FIG. 2 shows a front detailed front view of the premium-display space of the Premium-Dispensing Game of FIG. 1.

A more detailed view of premium-display space 106 is shown in FIG. 2. The lamps 112 framing display space 106 are arranged in four individual brackets. The top bracket 238 includes lamps L1–L12; the right side bracket 240 comprises lamps L13–23; the bottom bracket 242 comprises lamps L33–L44; and the left side bracket 244 comprises lamps L45–L64. As shown lamps L15, L20, L25, L30, L47, L52, L57 and L62 are each located adjacent respective premium-display carousels 108 and are shown as having a different luminescence than the remaining lamps. Thus, lamps L15, L20, L25, L30, L47, L52, L57 and L62 represent the "win" lamps 113.

Figures 3, 3A:
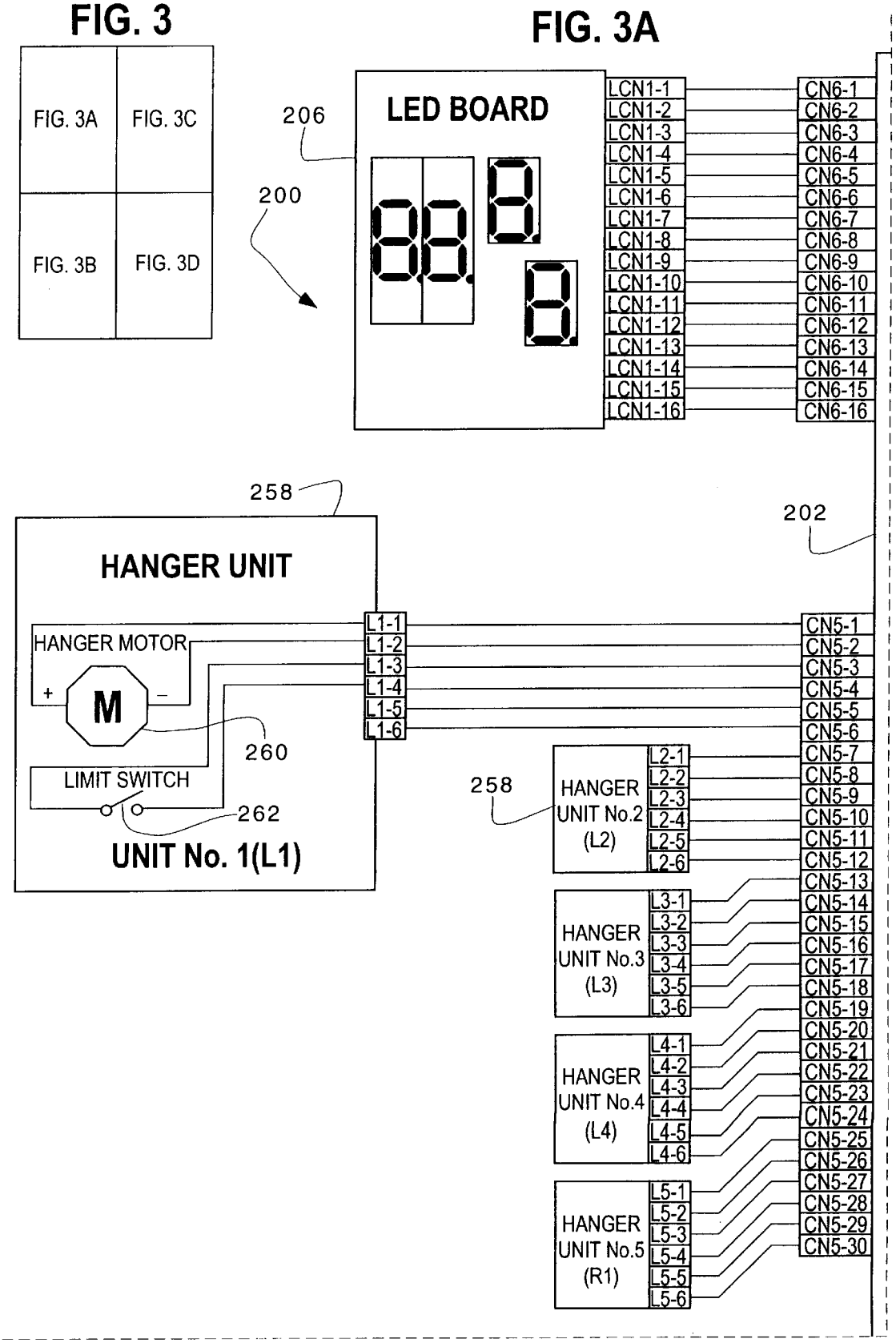
FIG. 3 shows a wiring diagram for the Premium-Dispensing Game of FIG. 1.
Figure 3C:
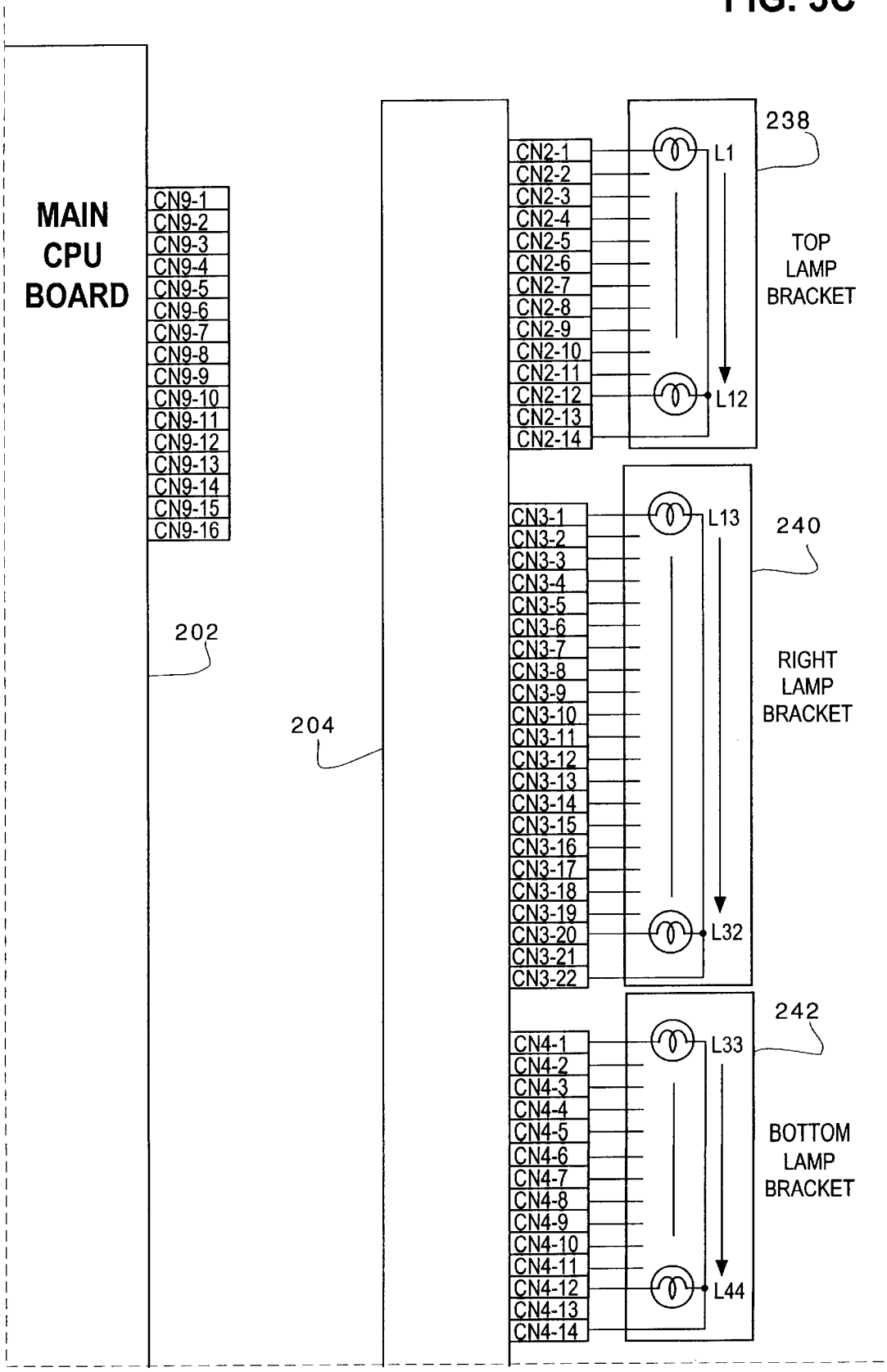
Figure 3D:
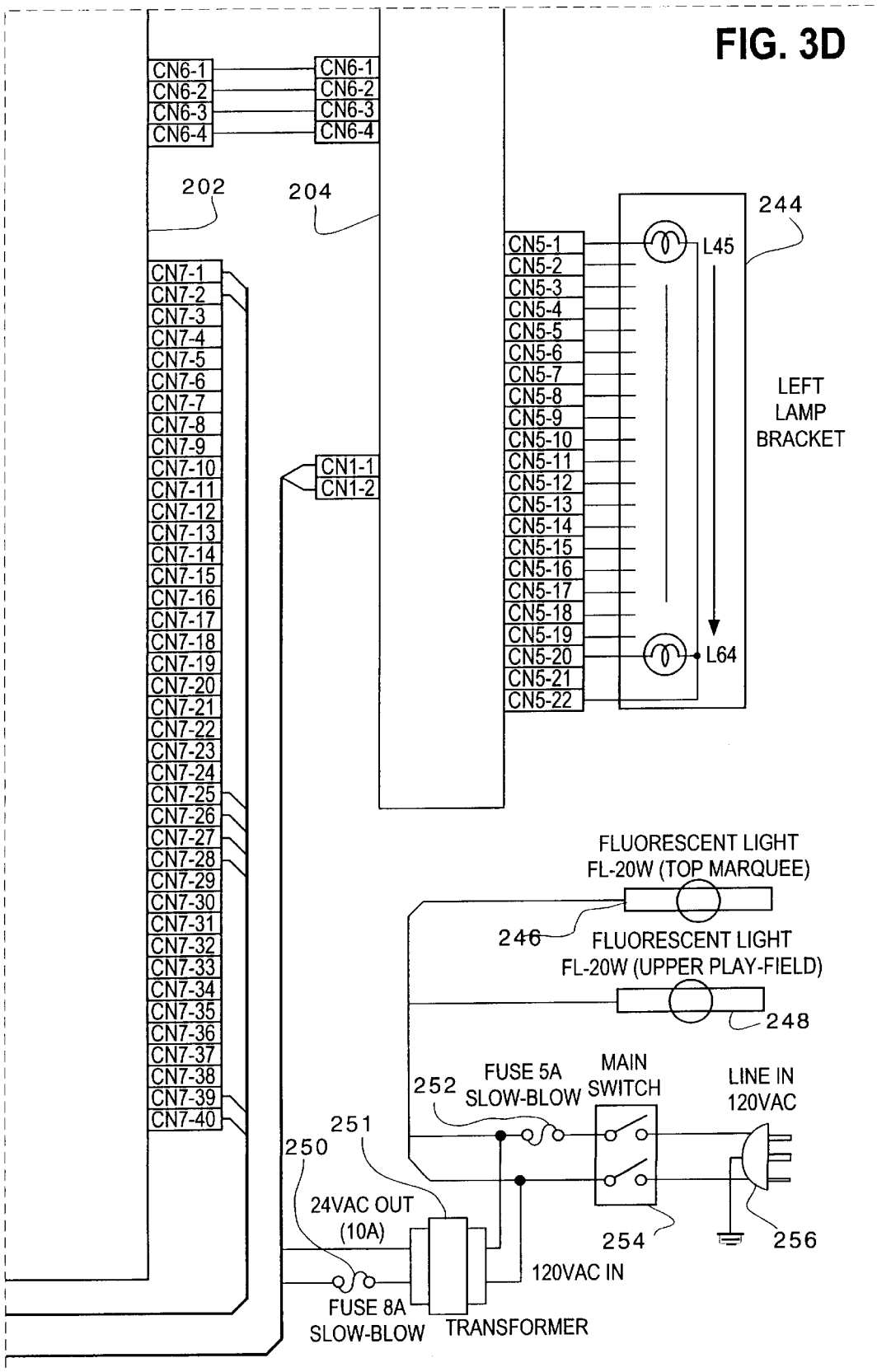

Turning now to FIG. 3 a wiring diagram for the premium-dispensing game of the present invention is shown at 200. The major components comprising the control circuitry for the premium-dispensing game include a central processing board (CPU) 202; a lamp drive board 204; an LED board 206; a counter unit 208; a coin door unit 214; a switch bracket 220; a plurality of hanger units 258; a speaker 237; and several additional input switches and output lamps.

Power is supplied to the game via a standard 120 VAC wall plug 256 which may be inserted into any conventional 120 VAC wall outlet (not shown). An On/Off switch 254 applies power to the game, and a 5 A fuse 252 is connected in series with On/Off switch 254 to provide short circuit protection. The 120 VAC input power is connected to a pair of fluorescent lamps 246 and 248 which illuminate the upper marquee and the premium-display space 106 respectively. The 120 VAC input power further drives a transformer 251 which transforms the 120 VAC input power to a 24 VAC output for driving the remaining components of the game.

Main CPU board 202 controls all operational aspects of the premium-dispensing game. The lamp drive board 204 is controlled directly by CPU 202 and drives the lamps 112 which frame the premium-display space 106 (see FIG. 1). The individual lamps driven by lamp drive board 204 are divided into the four separate groups, or lamp brackets as described in relation to FIG. 2. LED board 206 is also driven by CPU 202 and, in conjunction with switch bracket 220, displays various adjustable operating parameters as they are entered into CPU 202: i.e., the value of the premiums being dispensed, the price charged to play the game, a Win Expectation Value, and others (all of which will be discussed in more detail below). Switch bracket 220 includes four switches 222. 224, 226, and 228 which are connected as inputs to CPU 202. The various switches may be manipulated so that the CPU enters various program modes in which the values of the operating parameters may be changed. When a particular programming mode is entered, the LED board 206 displays a code for the particular parameter being adjusted, as well as the current value for that parameter. Further manipulation of the switches allows the value of the parameter to be changed, or a different parameter to be displayed.

Counter Unit 208 is also driven by outputs from CPU 202. The counter unit includes two digital display meters. The first meter 210 acts as a coin counter and displays the number of coins deposited through the coin slot located in the base. The second meter 212 counts premiums and displays a running total of the number of premiums which have been dispensed by the game.

The coin door unit 214 is mounted on a hinged panel in the front of the base. The coin door includes an illuminated slot for receiving coins inserted to operate the game. A bill acceptor 216 may be included in lieu of a coin slot or as a complement thereto so that players may insert coins and/or bills in order to play the game. Door unit 208 includes lamp 215 for illuminating the coin slot. A coin switch 218 is provided which provides an input to CPU 202 indicating that the proper amount of money has been deposited into either the coin slot or the bill acceptor so that the next play may begin.

The remaining inputs to CPU 202 include the stop switch 232 which is actuated by the stop button 116 (FIG. 1); a door switch 234; and a tilt switch 236. Both the door switch 234 and the tilt switch 236 act to disable the game, door switch 234 when the door to the premium display area is opened, and tilt switch 234 when someone has excessively rocked the game back and forth indicating an attempt to shake the premiums loose from their respective display carousels. Additional outputs include speaker 237, a stop button lamp 230 for illuminating the stop button, and a plurality of carousel drive units 258.

The preferred embodiment of the invention includes eight premium display carousels, and thus includes eight carousel drive units 258. Since the carousel drive units are identical for each carousel, only one is shown and described in detail. The carousel drive unit 258 includes a two-speed motor 260 and a premium-sensing limit switch 262. The mechanism by which display carousels 108 dispense premiums will be discussed in more detail below, but, at this point it should be noted that, when CPU 202 determines that a player has won a premium suspended from one of the display carousels, the CPU energizes the drive motor 260 of the designated carousel, causing that carousel to rotate at full speed. When limit switch 262 senses that a premium is approaching the drop point, CPU 202 drives motor 260 at a slower speed, thus slowing the rotation of the carousel. Finally, when limit switch 262 senses that the premium has been dispensed, motor 260 is stopped.

With reference to FIGS. 2 and 3, a player initiates a play by inserting the proper value of coinage or bills into either the coin slot or bill acceptor, whereupon coin switch 218 closes, providing a signal to CPU 202 that a new play has begun. Upon the initiation of a play, a first pre-recorded melody is played over speaker 237 and lamp drive board 204 may cause lamps L1–L64 to blink in a conspicuous attention-drawing manner. For example, only the win position lamps may be rapidly illuminated and extinguished in a rapid repetitive manner. Upon the completion of the first melody, a second, more rhythmic melody is played, and lamp drive board 204 begins sequentially illuminating lamps L1–L64 so that it appears that a single illuminated lamp is racing around the perimeter of the premium-display space 106. While the game is in this mode, the player attempts to stop the traveling light by pressing the stop button when one of the eight win lambs (L15, L20, L25, L30, L47, L52, L57 or L62) is illuminated. If the player is successful, the game stops with one of the win lamps illuminated, and the player wins the premium suspended from the display carousel adjacent the illuminated win lamp. The carousel drive unit 258 controlling the carousel adjacent the illuminated win lamp drives the carousel until the premium drops into the chute formed in the base 102 (see FIG. 1). As will be discussed in more detail below, the carousels include a switch for determining that a premium has in fact been dispensed. Thus, if a hook is empty, the carousel drive unit 258 will continue driving the carousel until a premium is actually dropped. If the carousel makes a full revolution and no premium is dispensed, the player will receive a free play.

If the player fails to stop the traveling light in one of the win positions, the player wins nothing and the play is over. A player must then re-enter the correct amount of money to initiate another play.

When a player approaches the game, it is apparent that a level of skill is required to win a premium. However, an element of chance is combined with the player's skill to determine when a prize is actually dispensed. Thus, a skillful player who properly times the pressing of the stop button 116 with the position of the travelling light will not necessarily win a prize every time, but a player must be skillful enough to properly time the pressing of the stop button to have any opportunity to win whatsoever. The element of chance which is combined with the player's skill, is adjustably weighted to the operator's advantage. When a player skillfully hits the stop button while one of the win position lamps is illuminated, a random number generator implemented in CPU 204 makes the determination of whether the player is a "winner" or not. The random number generator may be weighted so that over an extended number of plays, the game will pay out approximately a pre-determined number of times. For example the random number generator may be so weighted that a win is allowed 800 times per 10,000 plays on which a player properly times the stop button.

In the premium-dispensing game of the present invention, the number of pay-outs per 10,000 plays defines a Win Expectation Value. It is the Win Expectation Value which controls the weighting of the random number generator. A proper Win Expectation Value can be selected, such that the random number generator is weighted to assure an approximate minimum rate of return from the operation of the game. Furthermore, the game itself will calculate a proper Win Expectation Value based on parameters entered into CPU 202 by the operator. The CPU calculates the Win Expectation Value based on the value of the premiums being dispensed, the price being charged for each play, and the desired pay-out level. For example, suppose that a game operator is charging $2.00 per play, and dispensing premiums valued at $5.00 each. Suppose further that the operator wants to establish a 20% pay-out rate. In order to reach the 20% pay-out threshold, the game must take in a total of $25.00 for each premium awarded. At $2.00 per play, this corresponds to 1 win for every 12.5 plays. Averaged over 10,000 plays, this equates to a Win Expectation Value of 800. A different Win Expectation Value can be calculated by changing the price of the premium, altering the desired pay-out, or changing the price per play.

An important feature of the premium-dispensing game of the present invention is that the Win Expectation Value can be set differently for each premium-dispensing carousel 108. Thus, premiums of different value may be placed on different display carousels, or the pay-out percentage for some premiums may be set higher or lower than for others. In general, the higher-valued premiums will be placed on carousels having a lower Win Expectation Value so that the higher-valued premiums are harder to win. In any case, by setting the input parameters differently for each carousel, the resulting Win Expectation Value for each carousel will assure a certain fixed, though possibly different, rate of return for each carousel.

The parameters for establishing the Win Expectation Value are entered using switch bracket 220 and LED board 204. The value of the premiums 111 suspended from each carousel 108 may be entered into CPU 204 and displayed on LED board 206 by manipulating in various combinations the input switches 222, 224 226 and 228. The values of the premiums are entered via coded numbers 0–15. In the preferred embodiment the coded numbers represent prices according to the following table:

| Coded Entry | Value of Premium |
|---|---|
| 0 | $0.25 |
| 1 | $0.50 |
| 2 | $0.75 |
| 3 | $1.00 |
| 4 | $1.50 |
| 5 | $1.75 |
| 6 | $2.00 |
| 7 | $2.50 |
| 8 | $3.50 |
| 9 | $5.00 |
| 10 | $7.50 |
| 11 | $10.00 |
| 12 | $12.50 |
| 13 | $15.00 |
| 14 | $17.50 |
| 15 | $20.00 |

Similarly, the desired pay-out percentage for each carousel may also be entered and displayed by manipulating the input switches 222, 224, 226 and 228. Again the values are entered via coded numbers 0–15 which, in the preferred embodiment, represent pay out percentages according to the table below. However, it should be noted that the pay-out percentages listed below are representative values only, and may be altered as necessary.

| Coded Entry | Pay-Out Percentage | Coded Entry | Layout Percentage |
|---|---|---|---|
| 0 | 5% | 8 | 30% |
| 1 | 10% | 9 | 32.5% |
| 2 | 15% | 10 | 35% |
| 3 | 17.5% | 11 | 37.5% |
| 4 | 20% | 12 | 40% |
| 5 | 22.5% | 13 | 45% |
| 6 | 25% | 14 | 50% |
| 7 | 27.5% | 15 | 100% |

Finally, the price per play may also be entered into CPU 202 and displayed on LED board 206 by manipulating input switches 222, 224, 226 and 228. The price per play is entered via a coded number 0–19 each of which represents a price-per-play according to the following table:

| Coded Entry | Price Per Play |
|---|---|
| 0 | $0.25 |
| 1 | $0.50 |
| 2 | $0.75 |
| 3 | $1.00 |
| 4 | $1.25 |
| 5 | $1.50 |
| 6 | $1.75 |
| 7 | $2.00 |
| 8 | $2.25 |
| 9 | $2.50 |
| 10 | $2.75 |
| 11 | $3.00 |
| 12 | $3.25 |

-continued

| Coded Entry | Price Per Play |
|---|---|
| 13 | $3.50 |
| 14 | $3.75 |
| 15 | $4.00 |
| 16 | $4.25 |
| 17 | $4.50 |
| 18 | $4.75 |
| 19 | $5.00 |

Figure 4:
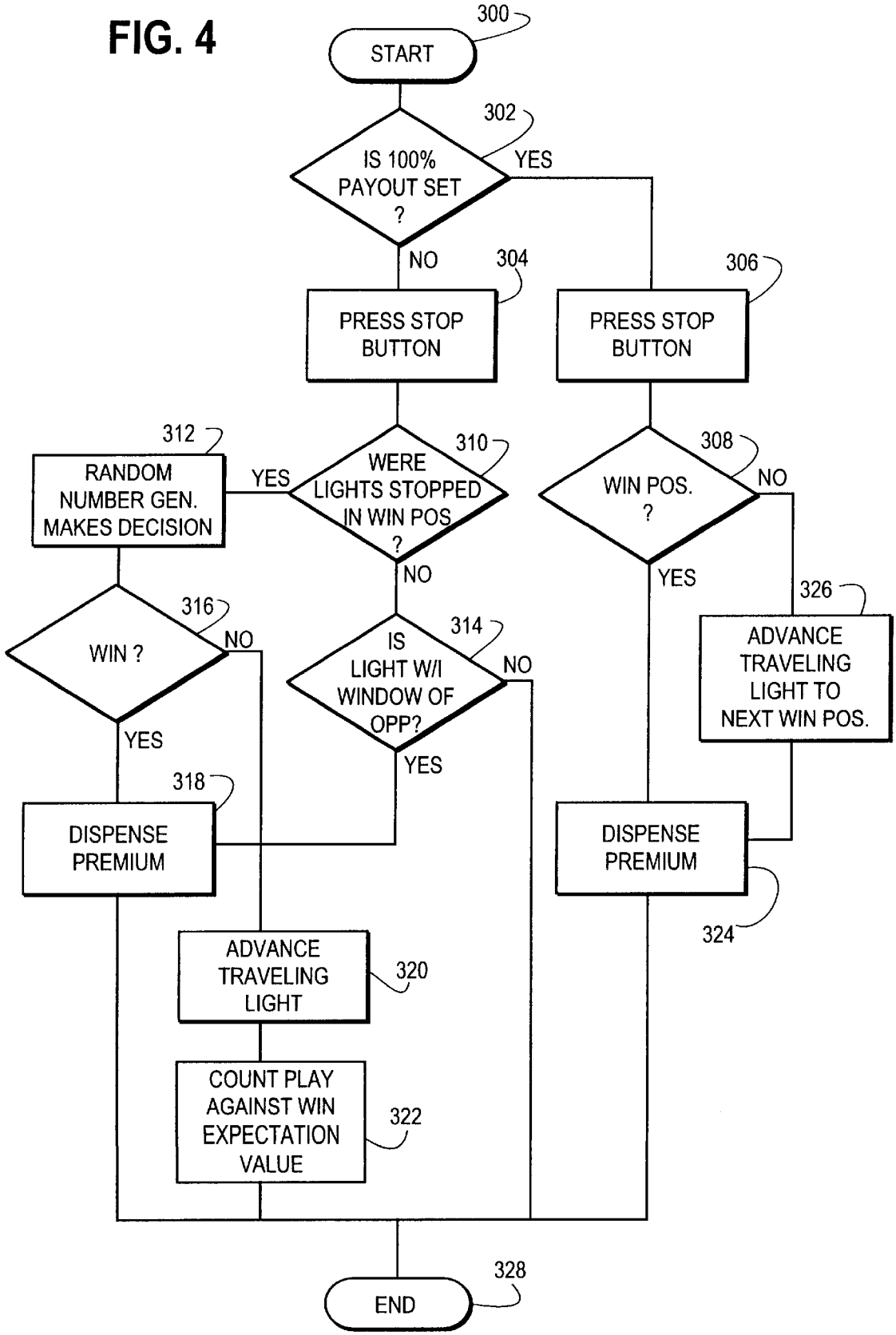
FIG. 4 shows a flow chart for each time the game is played.
Figure 5:
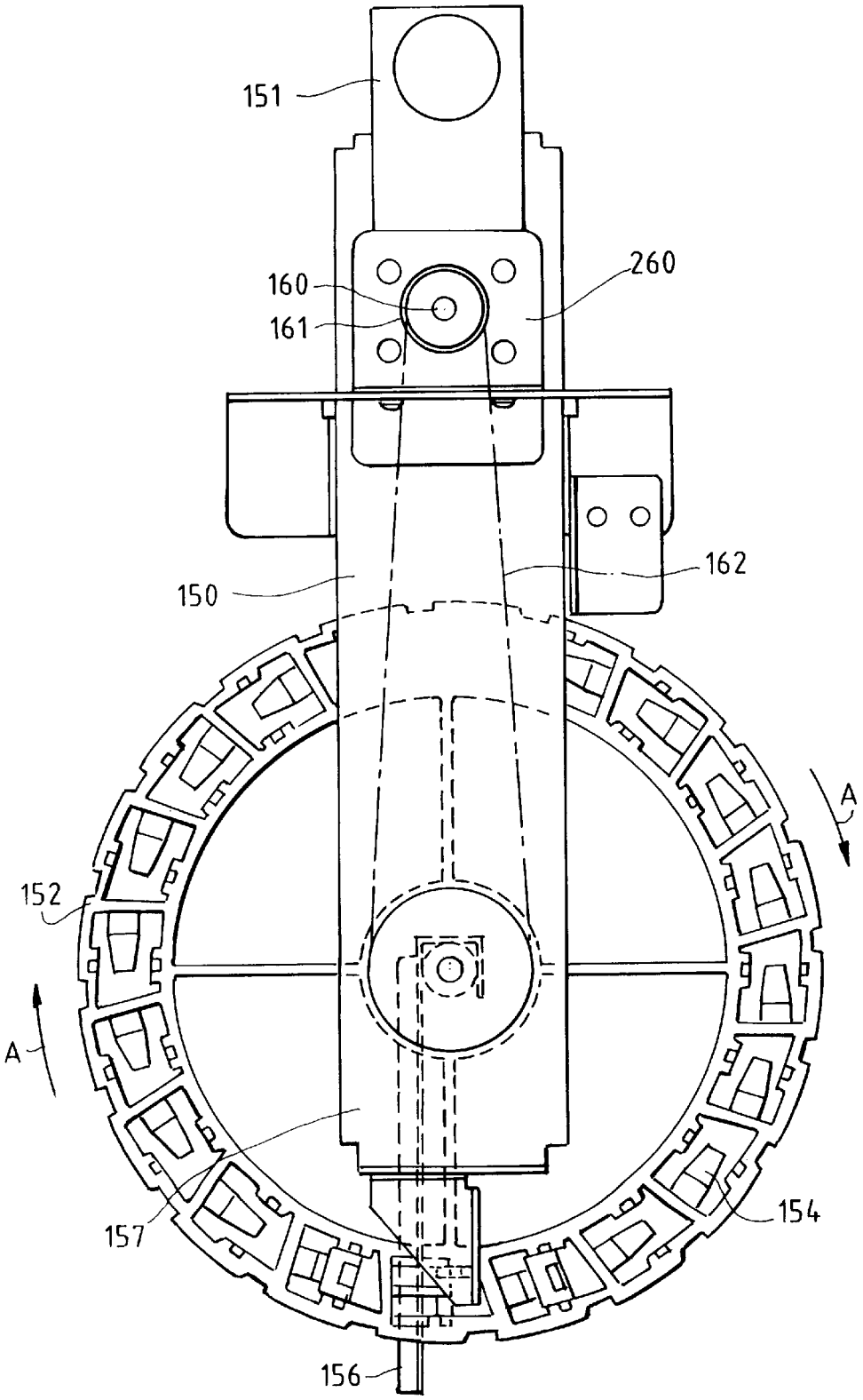
FIG. 5 shows a top view of one premium-dispensing carousel shown in FIGS. 1 and 2.
Figure 6:
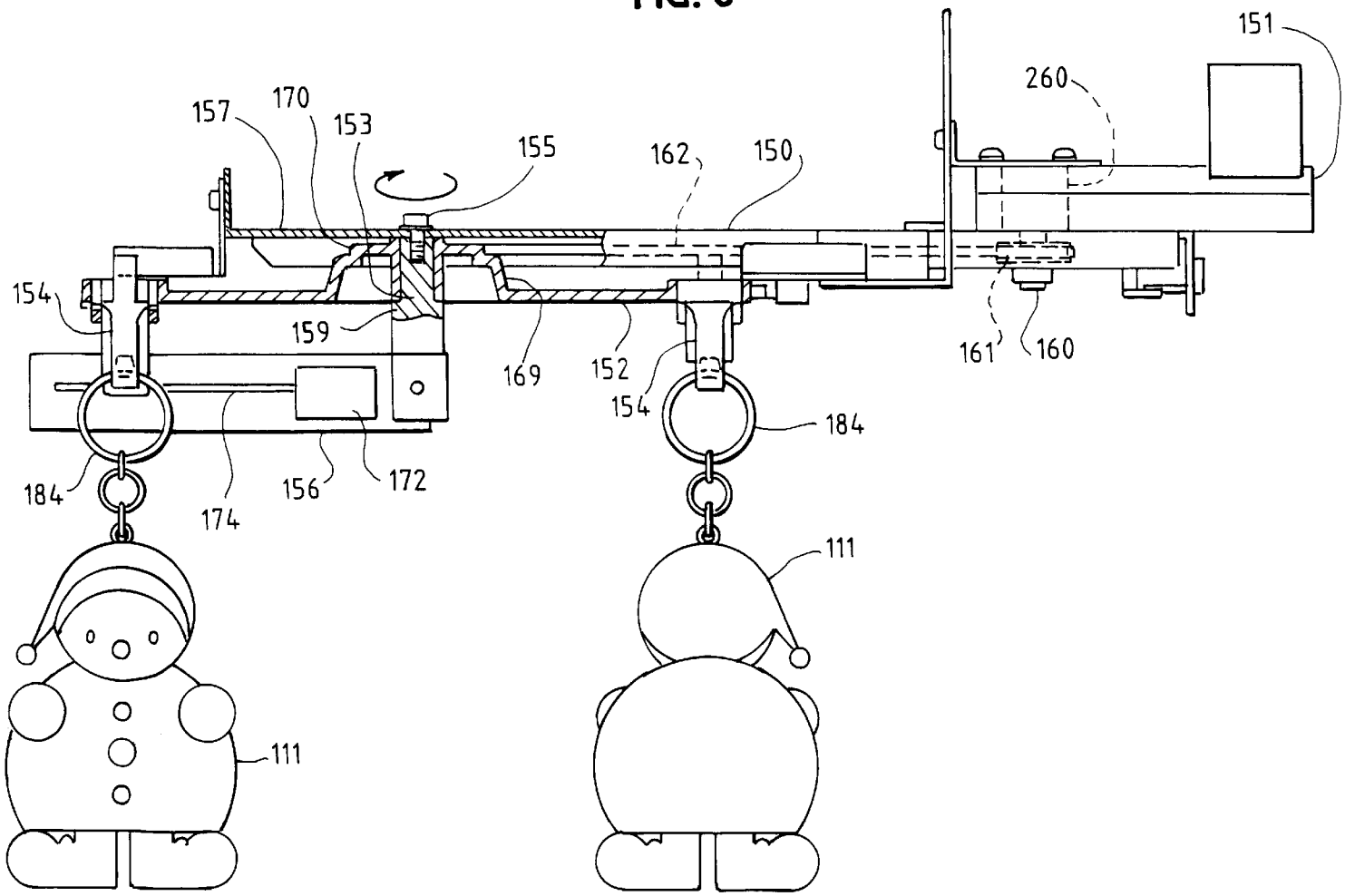
FIG. 6 shows a cross-section of the premium-dispensing carousel of FIG. 5 taken along the line 6—6.
Figure 7:
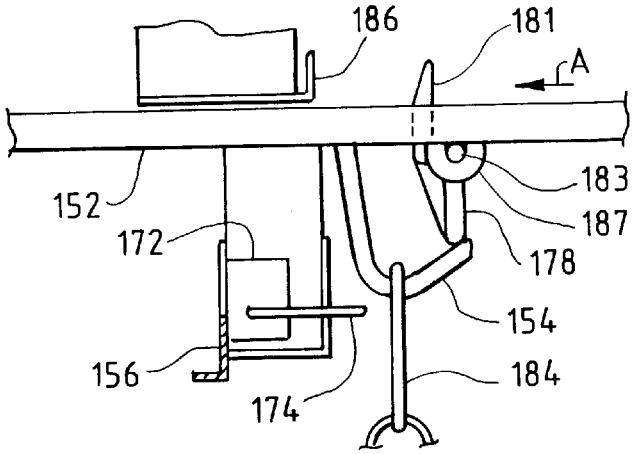
FIG. 7 shows a partial plan view of the premium-dispensing carousel of FIG. 5, wherein a hook-locking lever is shown in a closed position.

With reference to FIGS. 3 and 4, the element of chance is combined with the player's skill follows. The CPU controls the game according to the flow chart shown in FIG. 4. The game begins at block 300. At the first step, the CPU examines the programmed pay-out percentage in decision block 302. If the pay-out percentage is set at 100% the CPU control moves to action block 306 where it waits for an input indicating that the stop button has been hit and a lamp position is determined. Next, at decision block 308 the CPU determines whether the lamp position corresponds to any of the win positions. If yes, then the premium displayed from the carousel adjacent the illuminated win position is dispensed. If the lamp position does not correspond to one of the win positions, control moves to block 326 where the CPU, acting through the lamp control board, advances the traveling light to the next adjacent win lamp. At that time the motion of the traveling light is arrested, and the premium displayed on the display carousel adjacent the now-illuminated win lamp is dispensed at block 324. In either of the above cases, regardless of whether the player properly times the stop button, a prize is dispensed with each play. The game ends at 328 after the premium has been dispensed. In this mode the game 100 performs as purely as a vending machine, dispensing a premium for money received.

If, however, at decision block 302 the CPU control determines that the pay-out percentage is set at less than 100%, the control moves to action block 304 where it waits for an input indicating that the stop button has been hit and a lamp position is determined. Next, at decision block 310 the CPU determines whether the lamp position corresponds to any of the win positions. If yes, at action block 312 the random number generator makes a decision whether or not the player wins. Recall that the decision returned by the random number will be weighted according to the Win Expectation Value set for the particular display carousel adjacent the win light that is illuminated. Thus, the decision of the random number generator will be a function of the number of plays which have already occurred, and the number of prizes which have already been dispensed from the carousel adjacent the illuminated win lamp.

The decision of the random number generator is examined at decision block 316. If the random number generator determines that the player wins, the premium displayed on the carousel adjacent the illuminated win lamp is dispensed at block 318 and the game ends at 328. If the decision of the random number generator determines that the player does not win, at block 320 the traveling light is immediately advanced to a non-win lamp position so that it appears that the player mistimed hitting the stop button and no premium is dispensed from the nearly adjacent carousel. However, the play is counted against the Win Expectation Value as shown in block 322. Since the play is counted, the next time a player properly hits the stop button with the traveling light at a win position, the random number generator will be slightly more likely to return a win decision.

Returning to decision block 310, if the lamp position does not correspond to one of the win position lamps, control moves to decision block 314. Here the control determines whether the lamp position corresponds to a "window of opportunity" 128 (FIG. 2). A window of opportunity 128 is defined by the two lamp positions immediately preceding each win lamp position as illustrated in FIG. 2. (The direction of travel imparted to the traveling light may be either clockwise or counter-clockwise. In FIG. 2 the direction of travel is shown clockwise, and thus the windows of opportunity include the two lamps below the win position lamps in the left side lamp bracket and the two lamp positions above the win position lamps in the right side lamp bracket. If the direction of the traveling light is reversed, the windows of opportunity will shift so that the windows of opportunity will include the two lamp positions above the win position lamps in the left side lamp bracket, and the two lamp positions below the win position lamps in the right side lamp bracket.) If at block 314 the control determines that the lamp position is not within a window of opportunity, the game ends at 328. If, however, the illuminated lamp position does fall within a window of opportunity, the play is counted against the Win Expectation Value at block 322, increasing the chances that the random number generator will return a win decision on subsequent plays. After counting the play against the Win Expectation Value, the play ends at 328.

Turning now to FIGS. 1, and 5–10 the operation of the display carousels will now be described. Each premium support carousel comprises a support arm 150 which is mounted to the back panel of the upper casing 104 in such a way that the premium-dispensing carousel extends forward into premium-display space 106. A vertical shaft 153 is mounted near the distal end 157 of support arm 150 and held in place by mounting screw 155. A rotating member 152 in the form of a circular disc engages shaft 153 and is free to rotate thereabout. Shaft 153 includes a relatively larger diameter portion 159 below rotating member 152 so that when shaft 153 is mounted to support arm 150, rotating member 152 is supported by the larger diameter portion 159 of shaft 153, and is free to rotate about the axis of the shaft.

Also supported by shaft 153 are stationary resistance bar 156 and a premium-sensing microswitch 172. Resistance bar 156 extends parallel to support arm 156, and microswitch 172 may be mounted directly thereto. The actuator 174 of switch 172 comprises a long slender metal shaft which extends at the forward angle of approximately 20° relative to resistance bar 156.

A two-speed electric motor 260 (corresponding to the carousel drive motor described with reference to FIG. 3) is provided near the mounting end 151 of support member 150 for controlling the rotation of rotating member 152. Motor 260 includes an output shaft 160 and output pulley 161. Output shaft 160 turns output pulley 161 which then turns an output drive belt 162. Rotating member 152 further includes a raised spacer portion 169. A narrow section of raised portion 169 defines a large pulley 170 integrally formed with rotating member 152 and adapted to receive drive belt 162. Thus, the rotational output of electric motor 260 is transferred to rotating member 152.

The outer perimeter of rotating member 152 is formed with a plurality of depending premium support hooks 154. A premium support ring 184, or other support member attached to a premium, may be placed over the lower portion of a hook and a premium suspended therefrom. Thus, when all of the hooks 154 are loaded with premiums suspended in this manner, a full complement of attractive eye-catching prizes will be visible within premium-display space 106. In some cases the premiums may be too large to suspend from each hook. In such cases, the premiums may be suspended from every other hook, or every second hook as necessary. When a premium is to be dispensed, the carousel will continue rotating until the next loaded hook dispenses a premium.

Figure 8:
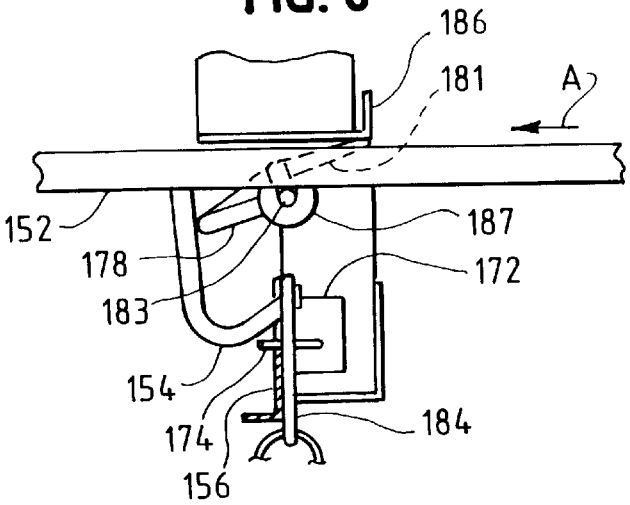
FIG. 8 shows the partial plan view of FIG. 7, but with the hook-locking lever shown in the open position.
Figure 9:
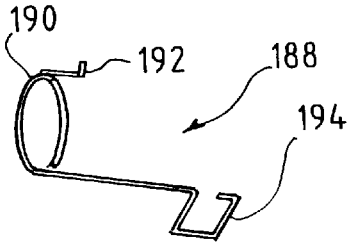
FIG. 9 shows a perspective view of a spring for biasing the hook-locking lever shown FIGS. 7 and 8 in the closed position.
Figure 10:
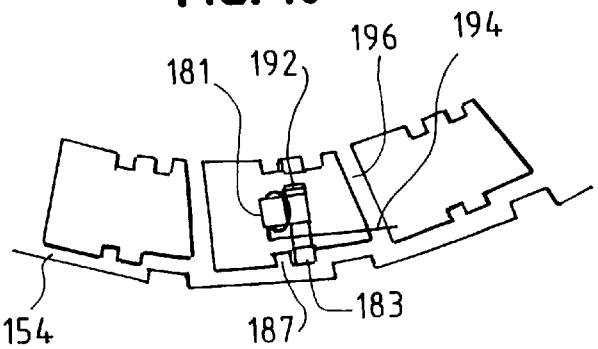
FIG. 10 shows a partial top view of the rotating member of a display carousel.

In order to prevent premiums from inadvertently falling from hooks 154, a pivotal hook locking lever 178 is provided for each hook 154. Locking lever 178 includes a lower downwardly extending locking arm 179 and an upwardly extending actuator arm 181. A pair of laterally extending shoulders 183 engage corresponding lever supports 187 formed in rotating member 152, to form the pivotal axis of locking lever 178. With shoulders 183 seated within lever supports 187, locking lever 178 is rotatable between a first locked position (FIG. 7) and a second open position (FIG. 8). In the locked position, lower locking arm 179 engages the end of hook 154 preventing support ring 184 from falling from the hook. In this position the actuating arm 181 extends generally vertically. A retention spring 188 shown separately in FIG. 10 is provided to bias locking lever 178 in the locked position. Retention spring 188 includes a coiled circular portion 190 configured to receive actuating arm 181 and a first end 192 engaging one of the mounting shoulders 183. Biasing force is created when the second end 194 is brought under tension into fixed engagement with a radial support 196.

When a player wins game 100, electric motor 280 causes rotating member 152 to rotate in the clockwise direction as indicated by arrow A in FIGS. 5 6, 7 and 8. Premiums are dispensed as they are rotated past resistance bar 156. Thus, when a player wins, rotating member 152 begins to rotate, and hooks 154 pass resistance bar 156. The next premium to be dispensed will be that premium suspended from the hook 154 immediately to the right of resistance bar 156 as viewed in FIG. 7.

As hook 154 approaches resistance bar 156 premium support ring 184 first contacts microswitch actuator 174, tripping microswitch 172. Thus, microswitch 172 provides a signal indicating that a premium is approaching resistance bar 156. In response, motor 260 slows from a first relatively fast speed to a second slower speed. As rotating member 152 continues rotating at this slower speed, the actuating arm 181 of locking lever 178 engages unlocking member 186. As hook 154 moves toward resistance bar 156, unlocking member 186 forces the entire locking lever 178 to rotate clockwise, thereby moving the lower locking arm 179 away from the end of hook 154, and opening the hook as shown in FIG. 8. Rotating member 152 continues rotating hook 154 past resistance bar 156, however resistance bar 156 engages premium support ring 184, preventing the premium from moving past the resistance bar. The resistance bar 156 pulls the support ring off the open hook 154 as the hook rotates past so that the premium falls to the bottom of the display space 106. Once hook 154 passes the drop position, the actuating arm of locking lever 178 clears unlocking member 186 and spring 188 pulls locking lever 178 backward in the counter-clockwise direction, again closing hook 154.

Once the premium drops from hook 154, microswitch actuator 174 springs back to its normal position, opening the switch contacts. The combination of closing, then opening the switch contacts provides positive indication that a premium has been successfully dispensed. Absent such indication, the rotating member 152 continues to rotate until a hook bearing a premium is rotated past the drop position.

Further, the action of microswitch 172 may be used to count how many premiums have been dispensed. The total derived from the switch count may be displayed on the second display meter 212 described in reference to FIG. 3.

It should be noted that various changes and modifications to the present invention may be made by those of ordinary skill in the art without departing from the spirit and scope of the present invention which is set out in more particular detail in the appended claims. Furthermore, those of ordinary skill in the art will appreciate that the foregoing description is by way of example only, and is not intended to be limiting of the invention as described in such appended claims.

What is claimed is:

1. A self-contained game wherein a player attempts to win one of a plurality of premiums, the game comprising:

a premium-display space;

a first plurality and a second plurality of lamps;

a controller configured to selectively illuminate and extinguish individual lamps comprising said first and second pluralities to give the appearance of a single light traveling amongst said first and second plurality of lights; and an interface whereby a player may signal the controller to arrest the apparent motion of said traveling light in an attempt to stop the traveling light at a position wherein one of said second plurality of lamps is illuminated, said controller being configured to determine which lamp was illuminated at the time the signal was received and make a determination as to whether a premium is to be dispensed;

a plurality of premium supports releasably supporting respective premiums within the premium-display space, each said support being associated with one of said second plurality of lamps;

upon making a determination that a premium is to be dispensed, said controller acting to continuously illuminate one of said second plurality of lamps, and to cause the premium support associated therewith to release a premium.

2. The game of claim 1 wherein each attempt to win a prize comprises a play, said game further comprising a money slot wherein a player deposits money to initiate a play and wherein the amount of money necessary to initiate a play is adjustable.

3. The game of claim 2 further comprising means for establishing an adjustable Win Expectation Value, said controller, in making the determination whether a premium is to be dispensed on a given play, being responsive to said win expectation value in such manner that over an extended number of plays an approximate predetermined average of premiums dispensed per play will be established.

4. The game of claim 3 further comprising means for establishing input parameters which may be programmed into said controller, said parameters comprising:

the price charged per play the value of individual premiums supported by each of said premium supports; and a pay-out percentage based on a desired financial return from operating said game.

5. The game of claim 4 wherein the premium value parameter may set to a different value for the premiums displayed on each of the premium supports.

6. The game of claim 4 wherein said controller is configured to calculate a separate Win Expectation Value for each of said premium supports.

7. The game of claim 1 wherein said premium supports comprise rotating carousels, each carousel comprising:

a rotating member including a plurality of hooks around an outer perimeter thereof from which premiums may be suspended;

a stationary resistance bar arranged to engage said premiums as said rotating member is rotated and drop said premiums from said hooks;

a two-speed electric motor for driving said rotating member; and a limit switch for sensing a premium as said premium is rotated toward said resistance bar, said two-speed motor being responsive to said limit switch in such manner that rotation of said rotating member is slowed as the premium approaches said resistance bar.

8. The game of claim 7 wherein said carousels further comprise hook-locking levers for closing said hooks when said hooks are not adjacent said resistance bar, and a spring for releasably biasing said levers in a closed position.

9. A self-contained game wherein a player attempts to win one of a plurality of premiums, the game comprising:

a premium-display space;

a first plurality and a second plurality of indicators;

a controller configured to sequentially distinguish and extinguish individual indicators comprising said first and second pluralities in a manner to give the appearance of a single indication traveling amongst said first and second plurality of indicators;

an interface whereby a player may signal the controller to arrest the apparent motion of said traveling indication in an attempt to stop the indication at a selected position, said controller being configured to determine which indicator was last distinguished at the time the signal was received and whether said last distinguished indicator is a member of said second plurality of indicators, said controller being further configured to make a decision whether a premium is to be dispensed based on the determination that said last distinguished indicator is a member of said second plurality of indicators; and a plurality of premium supports releasably supporting respective premiums within the premium-display space, each said support being associated with a respective one of said second plurality of indicators;

upon making a decision that a premium is to be dispensed, said controller acting to cause the premium support associated with said last-distinguished indicator to release a premium.

* * * * *